US006140292A

United States Patent [19]

Randall et al.

[11] Patent Number: 6,140,292

[45] Date of Patent: Oct. 31, 2000

[54] LAUNDRY DETERGENT COMPOSITIONS WITH POLYAMIDE-POLYAMINES

[75] Inventors: Sherri Lynn Randall, Hamilton; Rajan Keshav Panandiker, West Chester, both of Ohio

[73] Assignee: The Procter & Gamble Company, Cincinnati, Ohio

[21] Appl. No.: 09/331,987

[22] PCT Filed: Dec. 9, 1997

[86] PCT No.: PCT/US97/22567

§ 371 Date: Jun. 30, 1999

§ 102(e) Date: Jun. 30, 1999

[87] PCT Pub. No.: WO98/29530

PCT Pub. Date: Jul. 9, 1998

Related U.S. Application Data

[60] Provisional application No. 60/033,964, Dec. 31, 1996.

[51] Int. Cl.[7] ..... C11D 1/02; C11D 3/26; C11D 3/39; C11D 17/00; C11D 17/06

[52] U.S. Cl. ..... 510/300; 510/299; 510/305; 510/306; 510/309; 510/312; 510/313; 510/314; 510/315; 510/320; 510/323; 510/349; 510/351; 510/352; 510/357; 510/445; 510/446; 510/452; 510/499; 510/501

[58] Field of Search ..... 510/337, 336, 510/340, 361, 349, 501, 504, 299, 300, 305, 306, 309, 312, 313, 314, 315, 320, 323, 351, 352, 357, 445, 446, 452, 499

[56] References Cited

U.S. PATENT DOCUMENTS

| | | | |
|---|---|---|---|
| 2,220,099 | 11/1940 | Heidelberg et al. | 260/505 |
| 2,296,116 | 9/1942 | Pelc | 309/22 |
| 2,296,154 | 9/1942 | Elliot, Sr. | 312/36 |
| 2,477,383 | 7/1949 | Lewis | 252/161 |
| 3,332,901 | 7/1967 | Keim | 260/29.2 |
| 3,664,961 | 5/1972 | Norris | 252/99 |
| 3,723,250 | 3/1973 | Aunstrup et al. | 195/62 |
| 3,919,678 | 11/1975 | Penfold | 335/296 |
| 3,992,304 | 11/1976 | Minegishi et al. | 252/8.8 |
| 4,144,226 | 3/1979 | Crutchfield et al. | 528/231 |
| 4,179,382 | 12/1979 | Rudkin et al. | 252/8.8 |
| 4,222,905 | 9/1980 | Cockrell, Jr. | 252/547 |
| 4,239,659 | 12/1980 | Murphy | 252/524 |
| 4,246,495 | 1/1981 | Pressman | 307/141 |
| 4,412,934 | 11/1983 | Chung et al. | 252/186.38 |
| 4,435,307 | 3/1984 | Barbesgaard et al. | 252/174.12 |
| 4,483,781 | 11/1984 | Hartman | 252/174.12 |
| 4,545,784 | 10/1985 | Sanderson | 8/107 |
| 4,605,509 | 8/1986 | Corkill et al. | 252/131 |
| 4,634,551 | 1/1987 | Burns et al. | 252/102 |
| 4,663,071 | 5/1987 | Bush et al. | 252/174.19 |
| 4,664,848 | 5/1987 | Oh et al. | 252/547 |
| 4,869,150 | 9/1989 | Post et al. | 89/11 |
| 4,915,854 | 4/1990 | Mao et al. | 252/8.8 |
| 4,966,723 | 10/1990 | Hodge et al. | 252/102 |
| 5,904,451 | 5/1999 | Gerber | 408/56 |
| 5,908,707 | 6/1999 | Cabell et al. | 428/537.5 |

FOREIGN PATENT DOCUMENTS

| | | | |
|---|---|---|---|
| 0 130 756 A1 | 1/1985 | European Pat. Off. | C12N 15/00 |
| 0 133 354 A1 | 2/1985 | European Pat. Off. | A61K 7/30 |
| 0 341 947 B1 | 8/1994 | European Pat. Off. | C11D 3/39 |
| 1 372 034 | 10/1974 | United Kingdom | C11D 7/42 |
| 2 075 028 | 11/1981 | United Kingdom | C12N 9/42 |
| 2 095 275 | 9/1982 | United Kingdom | C11D 3/386 |
| WO 91/17243 | 11/1991 | WIPO | C12N 9/42 |
| WO 93/03529 | 2/1993 | WIPO | H02H 5/04 |
| WO 93/18140 | 9/1993 | WIPO | C12N 9/54 |
| WO 94/25583 | 11/1994 | WIPO | C12N 9/76 |
| WO 95/10591 | 4/1995 | WIPO | C11D 3/386 |
| WO 97/42287 | 11/1997 | WIPO | C11D 3/37 |

*Primary Examiner*—Gregory R. Delcotto
*Attorney, Agent, or Firm*—Marianne Dressman; Kim William Zerby; Jacobus C. Rasser

[57] ABSTRACT

Detergent compositions and fabric laundering and treating methods utilize certain polyamide-polyamines as fabric treatment agents that can impart fabric appearance benefits to fabric laundered or treated in washing or soaking solutions which contain such agents. Such polyamide-polyamine fabric treatment agents include adipic acid-diethylenetriamine-epichlorohydrin adducts.

13 Claims, No Drawings

LAUNDRY DETERGENT COMPOSITIONS WITH POLYAMIDE-POLYAMINES

The present application claims priority to Provisional Application 60/033,964, filed Dec. 31, 1996.

TECHNICAL FIELD

The present invention relates to heavy duty laundry detergent compositions, in either liquid or granular form, which contain certain types of polyamide-polyamine materials to impart appearance benefits to fabrics and textiles laundered in washing solutions formed from such compositions.

BACKGROUND OF THE INVENTION

It is, of course, well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the appearance of such fabrics and textiles.

Deterioration of fabric appearance can manifest itself in several ways. Short fibers are dislodged from woven and knit fabric/textile structures by the mechanical action of laundering. These dislodged fibers may form lint, fuzz or "prills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which could be added to laundry detergent products that would associate themselves with the fibers of the fabrics and textiles laundered using such detergent products and thereby reduce or minimize the tendency of the laundered fabric/textiles to deteriorate in appearance. Any such detergent product additive material should, of course, be able to benefit fabric appearance without unduly interfering with the ability of the laundry detergent to perform its fabric cleaning function. The present invention is directed to detergent compositions containing certain types of polyamide-polyamine materials that perform in this desired manner.

SUMMARY OF THE INVENTION

The laundry detergent compositions herein comprise from about 1% to 80% by weight of a detersive surfactant, from about 0.1% to 80% by weight of an organic or inorganic detergency builder and from about 0.1% to 8% by weight of certain types of polyamide-polyamine fabric treatment agents. The detersive surfactant and detergency builder materials can be any of those useful in conventional laundry detergent products. The polyamide-polyamine materials are those which are comprised of repeating amido-amine units which may be substituted and/or derivatized as shown in the general Structural Formula No. I set forth hereinafter in the "Detailed Description of the Invention" section.

Particularly preferred polyamide-polyamine materials for use in the detergent and fabric treatment compositons herein comprise the reaction products of epichlorohydrin with polyamide-polyamines formed from adipic acid and diethylenetriamine. Such materials are commercially available under the tradename Kymene®.

In its method aspect, the present invention relates to the laundering or treating of fabrics and textiles in aqueous washing or treating solutions formed from effective amounts of the detergent compositions described herein, or formed from the individual components of such compositions. Laundering of fabrics and textiles in such washing solutions, followed by rinsing and drying, imparts fabric appearance benefits to the fabric and textile articles so treated. Such benefits can include improved overall appearance, prills/fuzz reduction, and antifading.

DETAILED DESCRIPTION OF THE INVENTION

As noted, the laundry detergent compositions of the present invention essentially contain detersive surfactant, detergent builder and certain polyamide-polyamine fabric treatment agents which serve to enhance fabric appearance upon use of the detergent compositions to launder fabrics and textiles. Each of these essential detergent composition components, as well as optional ingredients for such compositions and methods of using such compositions, are described in detail as follows: All percentages and ratios given are by weight unless other specified.

A) Detersive Surfactant

The detergent compositions herein essentially comprise from about 1% to 80% by weight of a detersive surfactant. Preferably such compositions comprise from about 5% to 50% by weight of this surfactant. Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, Issued May 23, 1972; U.S. Pat. No. 3,919,678, Laughlin et al., Issued Dec. 30, 1975; U.S. Pat. No. 4,222,905, Cockrell, Issued Sep. 16, 1980; and in U.S. Pat. No. 4,239,659, Murphy, Issued Dec. 16, 1980. All of these patents are incorporated herein by reference. Of all the surfactants, anionics and nonionics are preferred.

Useful anionic surfactants can themselves be of several different types. For example, water-soluble salts of the higher fatty acids, i.e., "soaps", are useful anionic surfactants in the compositions herein. This includes alkali metal soaps such as the sodiun, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$–$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Preferred nonionic surfactants are those of the formula $R^1(OC^2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides of the formula:

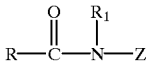

wherein R is a $C_{9-17}$ alkyl or alkenyl, $R_1$ is a methyl group and Z is glycityl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

B) Detergent Builder

The detergent compositions herein also essentially comprise from about 0.1% to 80% by weight of a detergent builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al, U.S. Pat. No. 4,605,509, the disclosure of which is incorporated herein by reference. Also, crystalline layered silicates such as those discussed in Corkill et al, U.S. Pat. No. 4,605,509, incorporated herein by reference, are suitable for use in the detergent compositions of this invention.

C) Polyamide-Polyamine Materials

The third essential component of the detergent compositions herein comprises one or more polyamide-polyamine materials fabric treatment agents. Such materials have been found to impart a number of appearance benefits to fabrics and textiles laundered in aqueous washing solutions formed from detergent compositions which contain such polyamide-polyamines. These fabric appearance benefits can include, for example, improved overall appearance of the laundered fabrics, reduction of the formation of prills and fizz, protection against color fading, etc. The polyamine-polyamide polymers used in the compositions and methods herein can provide such fabric appearance benefits with acceptably little or no loss in cleaning performance provided by the laundry detergent compositions into which such materials are incorporated.

The polyamide-polyamines useful herein will generally comprise from about 0.1% to 8% by the weight of the composition. More preferably, such polyamide-polyamine materials will comprise from about 0.5% to 4% by weight of the compositions herein. Most preferably, these polyamide-polyamines will comprise from about 1% to 3% by weight of the composition.

The polyamide-polyamine materials used in this invention are those which have repeating, substituted amidoamine units which correspond to the general Structural Formula No. I as follows:

Structural Formula No. I

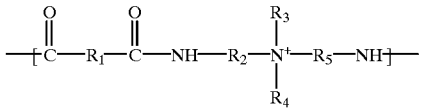

In Structural Formula No. I, $R_1$, $R_2$ and $R_5$ are each independently $C_{1-4}$ alkylene, $C_{1-4}$ alkarylene or arylene. It is also possible to eliminate $R_1$ entirely so that the polyamide-polyamine is derived from oxalic acid.

Also in Structural Formula No. I, $R_3$ is H, epichlorohydrin, an azetidinium group, an epoxypropyl group or a dimethylaminohydroxypropyl group, and $R_4$ can be H, $C_{1-4}$ alkyl, $C_{1-4}$ alkaryl, or aryl. $R_4$ may also be any of the foregoing groups condensed with $C_{1-4}$ alkylene oxide.

$R_1$ is preferably butylene, and $R_2$ and $R_5$ are preferably ethylene. $R_3$ is preferably epichlorohydrin. $R_4$ is preferably H.

The polyamide-polyamine materials useful herein can be prepared by reacting polyamines such as diethylenetriamine, triethylenetetraamine, tetraethylenepentamine or dipropylenetriamine with $C_2$–$C_{12}$ dicarboxylic acids such as oxalic, succinic, glutaric, adipic and diglycolic acids. Such materials may then be further derivatized by reaction with, for example, epichiorohydrin. Preparation of such materials is described in greater detail in Keim, U.S. Pat. No. 2,296,116, Issued Feb. 23, 1960; Keim, U.S. Pat. No. 2,296,154, Issued Feb. 23, 1960 and Keim, U.S. Pat. No. 3,332,901, Issued Jul. 25, 1967. The disclosures of all three of these patents are incorporated herein by reference.

The polyamide-polyamine-epichlorohydrin fabric treatment agents preferred for use herein are commercially marketed by Hercules, Inc. under the tradename Kymene® Especially useful are Kymene 557H® and Kymene 557LX® which are epichlorohydrin adducts of polyamide-polyamines which are the reaction products of diethylenetriamine and adipic acid. Other suitable materials are those marketed by Hercules under the tradenames Reten® and Delsette®, and by Sandoz under the tradename Cartaretin®. These polyamide-polyamine materials are marketed in the form of aqueous suspensions of the polymeric material containing, for example, about 12.5% by weight of solids.

D) Optional Detergent Ingredients

In addition to the essential surfactants, builders and polyamide-polyamines hereinbefore described, the detergent composition of the present invention can also include any number of additional optional ingredients. These include conventional detergent composition components such as bleaches and bleach activators, enzymes and enzyme stabilizing agents, suds boosters or suds suppressers, anti-tarnish and anticorrosion agents, soil suspending agents, soil release agents, germicides, pH adjusting agents, non-builder alkalinity sources, chelating agents, organic and inorganic fillers, solvents, hydrotropes, optical brighteners, dyes and perfumes.

A preferred optional ingredients for incorporation into the detergent compositions herein comprises a bleaching agent, e.g., a peroxygen bleach. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include $^{6}$-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used, generally in particulate form, in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966,723, Issued Oct. 30, 1990, incorporated herein by reference. A highly preferred activator of the benzoxazin-type is:

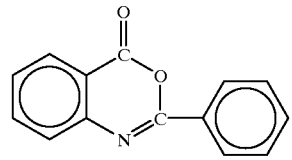

Still another class of useful bleach activators includes the acyl lactam activators, especially acyl caprolactams and acyl valerolactams of the formulae:

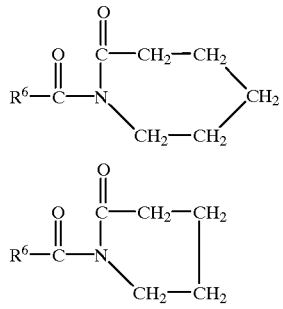

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, nonanoyl valerolactam, decanoyl valerolactam, undecenoyl valerolactam, 3,5,5-trimethylhexanoyl valerolactam and mixtures thereof. See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If utilized, peroxygen bleaching agent will generally comprise from about 2% to 30% by weight of the detergent compositions herein. More preferably, peroxygen bleaching agent will comprise from about 2% to 20% by weight of the compositions. Most preferably, peroxygen bleaching agent will be present to the extent of from about 3% to 15% by weight of the compositions herein. If utilized, bleach activators can comprise from about 2% to 10% by weight of the detergent compositions herein. Frequently, activators are employed such that the molar ratio of bleaching agent to activator ranges from about 1:1 to 10:1, more preferably from about 1.5:1 to 5:1.

Another highly preferred optional ingredient in the detergent compositions herein is a detersive enzymes component. Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fimgal enzymes are preferred, such as bacterial amylases and proteases, and fungal cellulases.

"Detersive enzyme", as used herein, means any enzyme having a cleaning, stain removing or otherwise beneficial effect in a laundry detergent composition. Preferred enzymes for laundry purposes include, but are not limited to, proteases, cellulases, lipases, amylases and peroxidases.

Enzymes are normally incorporated into detergent compositions at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. Higher active levels may be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

Cellulases usable herein include both bacterial and fungal types, preferably having a pH optimum between 5 and 10. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

Suitable lipase enzymes for detergent usage include those produced by microorganisms of the Pseudomonas group, such as *Pseudomonas stutzeri* ATCC 19,154, as disclosed in GB 1,372,034. See also lipases in Japanese Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum var.* lipolyticum NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein.

The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

E) Detergent Composition Preparation

The detergent compositions according to the present invention can be in liquid, paste or granular forms. Such compositions can be prepared by combining the essential and optional components in the requisite concentrations in any suitable order and by any conventional means.

Granular compositions, for example, are generally made by combining base granule ingredients (e.g. surfactants, builders, water, etc.) as a slurry, and spray drying the resulting slurry to a low level of residual moisture (5–12%). The remaining dry ingredients can be admixed in granular powder form with the spray dried granules in a rotary mixing drum and the liquid ingredients (e.g. aqueous suspensions of the essential polyamide-polyamines, enzymes, binders and perfumes) can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents.

Addition of the polyamide-polyamine component to liquid detergent compositions of this invention may be accomplished by simply mixing into the liquid detergent aqueous suspensions of the desired polyamide-polyamine. Such polyamide-polyamide materials can alter the viscosity or other rheological characteristics of liquid detergent products. It may therefore be necessary to compensate for any rheological changes in the liquid detergent product brought about by polyamide-polyamine addition by altering the type and amount of hydrotropes and/or solvents that are used.

F) Fabric Laundering Method

The present invention also provides a method for laundering fabrics in a manner which imparts fabric appearance benefits provided by the polyamide-polyamine materials used herein. Such a method employs contacting these fabrics with an aqueous washing solution formed from an effective amount of the detergent compositions hereinbefore described or formed from the individual components of such compositions. Contacting of fabrics with washing solution will generally occur under conditions of agitation although the compositions of the present invention may also be used to form aqueous unagitated soaking solutions for fabric cleaning and treatment.

Agitation is preferably provided in a washing machine for good cleaning. Washing is preferably followed by drying the wet fabric in a conventional clothes dryer. An effective amount of the liquid or granular detergent composition in the aqueous wash solution in the washing machine is preferably from about 500 to about 7000 ppm, more preferably from about 1000 to about 3000 ppm.

G) Fabric Conditioning

The polyamide-polyamines hereinbefore described as components of the laundry detergent compositions herein may also be used to treat and condition fabrics and textiles in the absence of the surfactant and builder components of the detergent composition embodiments of this invention. Thus, for example, a fabric conditioning composition comprising only the polyamide-polyamines themselves, or comprising an aqueous solution or suspension of the polyamide-polyamines, may be added during the rinse cycle of a conventional home laundering operation in order to impart the desired fabric appearance benefits hereinbefore described.

EXAMPLES

The following examples illustrate the compositions of the present invention, but are not necessarily meant to limit or otherwise define the scope of the invention.

Examples 1–24

Liquid Detergent Test Composition Preparation

Several heavy duty liquid (HDL) detergent compositions are prepared containing various polyamide-polyamines. Such liquid detergent compositions all have the following basic formula:

| Component | Wt. % |
|---|---|
| $C_{12-15}$ alkyl ether (2.5) sulfate | 19.0 |
| $C_{12-13}$ alkyl ethoxylate (9.0) | 2.00 |
| $C_{12-14}$ glucose amide | 3.50 |
| Citric Acid | 3.00 |
| $C_{12-14}$ Fatty Acid | 2.00 |
| MEA | to pH 8 |
| Ethanol | 3.41 |
| Propanediol | 6.51 |
| Borax | 2.5 |
| Dispersant | 1.18 |
| Na Toluene Sulfonate | 2.50 |
| Polyamide-polyamine (See Table 1) | as in Table 1 |
| Dye, Perfume, Brighteners, Enzymes, Preservatives, Suds Suppressor, Other Minors, Water | Balance |
| | 100% |

TABLE 1

Polyamides Used in Liquid Test Detergents

| Example # | Polyamide | Supplier | Wt. % Active in HDL |
|---|---|---|---|
| 1 | Kymene 557H | Hercules | 3.2 |
| 2 | Kymene 557H | Hercules | 2.0 |
| 3 | Kymene 557H | Hercules | 1.6 |
| 4 | Kymene 557 LX | Hercules | 3.2 |
| 5 | Kymene 557 LX | Hercules | 2.0 |
| 6 | Kymene 450 | Hercuies | 3.2 |
| 7 | Kymene 450 | Hercules | 2.0 |
| 8 | Reten 201 | Hercules | 3.2 |
| 9 | Reten 203 | Hercules | 3.2 |
| 10 | Delsette 101 | Hercules | 6.4 |
| 11 | Delsette 101 | Hercules | 4.8 |
| 12 | Delsette 101 | Hercules | 3.2 |
| 13 | Delsette 101 | Hercules | 1.6 |
| 14 | Cartaretin F4 | Sandoz | 4.8 |
| 15 | Cartaretin F4 | Sandoz | 1.6 |
| 16 | Cataretin F23 | Sandoz | 1.6 |
| 17 | Polymer 567 (adipic acid/DETA copolymer) | Hercules | 4.8 |
| 18 | Polymer 567 (adipic acid/DETA copolymer) | Hercules | 1.6 |
| 19 | adipic acid/DETA copolymer - 32% methyl substituted | Hercules | 3.2 |
| 20 | adipic acid/DETA colpolymer - 63% methyl substituted | Hercules | 3.2 |
| 21 | adipic acid/DETA copolymer - 84% methyl substituted | Hercules | 3.2 |
| 22 | adipic acid/DETA copolymer - 25% epichlorohydrin substituted | Hercules | 3.2 |
| 23 | adipic acid/DETA copolymer - 50% epichlorohydrin substituted | Hercules | 3.2 |
| 24 | adipic acid/DETA copolymer - 75% epichlorohydrin substituted | Hercules | 3.2 |

Example 25–48

Granular Detergent Test Composition Preparation

Several heavy duty granular (HDG) detergent compositions are prepared containing various polyamide-polyamines. Such granular detergent compositions all have the following basic formula:

| Component | Wt. % |
|---|---|
| $C_{12}$ Linear alkyl benzene sulfonate | 9.31 |
| $C_{14-15}$ alkyl sulfonate | 12.74 |
| Zeolite Builder | 27.79 |
| Sodium Carbonate | 27.31 |
| PEG 4000 | 1.60 |
| Dispersant | 2.26 |
| $C_{12-13}$ alkyl ethoxylate (E9) | 1.5 |
| Sodium Perborate | 1.03 |
| Soil Release Polymer | 0.41 |
| Enzymes | 0.59 |
| Polyamide-polyamine | as in Table 2 |
| Perfume, Brightener, Suds Suppressor, Other Minors, Moisture, Sulfate | Balance |
| | 100% |

TABLE 2

Polyamides Used in Granular Test Detergents

| Example # | Polyamide | Supplier | Wt. % Active in HDG |
|---|---|---|---|
| 25 | Kymene 557H | Hercules | 1.0 |
| 26 | Kymene 557H | Hercules | 1.5 |
| 27 | Kymene 557H | Hercules | 2.0 |
| 28 | Kymene 557 LX | Hercules | 2.0 |
| 29 | Kymene 557 LX | Hercules | 2.5 |
| 30 | Kymene 450 | Hercules | 2.0 |
| 31 | Kymene 450 | Hercules | 2.5 |
| 32 | Reten 201 | Hercules | 2.0 |
| 33 | Reten 203 | Hercules | 2.5 |
| 34 | Delsette 101 | Hercules | 1.0 |
| 35 | Delsette 101 | Hercules | 1.8 |
| 36 | Delsette 101 | Hercules | 2.4 |
| 37 | Delsette 101 | Hercules | 3.2 |
| 38 | Cartaretin F4 | Saridoz | 2.0 |
| 39 | Cartaretin F4 | Sandoz | 2.5 |
| 40 | Cartaretin F23 | Sandoz | 2.5 |
| 41 | Polymer 567 (adipic acid/DETA copolymer) | Hercules | 2.0 |
| 42 | Polymer 567 (adipic acid/DETA copolymer) | Hercules | 2.5 |
| 43 | adipic acid/DETA copolymer - 32% methyl substituted | Hercules | 2.5 |
| 44 | adipic acid/DETA copolymer - 63% methyl substituted | Hercules | 2.5 |
| 45 | adipic acid/DETA copolymer - 84% methyl substituted | Hercules | 2.5 |
| 46 | adipic acid/DETA copolymer - 25% epichlorohydrin substituted | Hercules | 2.5 |
| 47 | adipic acid/DETA copolymer - 50% epichlorohydrin substituted | Hercules | 2.5 |
| 48 | adipic acid/DETA copolymer - 75% epichlorohydrin substituted | Hercules | 2.5 |

What is claimed is:

1. A granular laundry detergent composition which imparts fabric appearance benefits, including pRill/fuzz reduction and antifading, to fabrics and textiles laundered in aqueous washing solutions formed therefrom, said composition comprising:

A) from 5% to 50% by weight of a detersive surfactant;

B) from 1% to 50% by weight of an organic or inorganic detergency builder;

C) from 0.1% to 8% by weight of a polyamide-polyamine fabric treatment agent formed from repeating units of the structural formula:

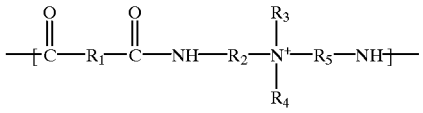

wherein $R_1$, $R_2$ and $R_5$ are each independently $C_{1-4}$ alkylene, $C_{1-4}$ alkarylene or arylene, or wherein $R_1$ may not be present;

wherein $R_3$ is H, epichiorohydrin, an azetidinium group, an epoxypropyl group or a dimethylamino-hydroxypropyl group; and wherein $R_4$ is H, $C_{1-4}$ alkyl, $C_{1-4}$ alkaryl, or aryl groups, and wherein said $R_4$ groups may optionally be condensed with $C_{1-4}$ alkylene oxide; and D) from 0.001% to 5%, by weight, enzyme.

2. A laundry detergent composition according to claim 1, wherein the enzyme e is selected from the group consisting of proteases, cellulases, lipases, amylases, peroxidases and mixtures thereof, and wherein the laundry detergent composition further comprises from about 0.00 1% to about 10%, by weight, of an enzyme stabilizing system.

3. A laundry detergent composition according to claim 1, comprising from 1.5% to 8% by weight of the polyamide-polyamine fabric treatment agent.

4. A laundry detergent composition according to claim 1, wherein the detergency builder is selected from the group consisting of aluminosilicates, silicates and mixtures thereof.

5. A laundry detergent composition according to claim 1, further comprising a peroxygen bleaching agent and a bleach activator in a weight ratio of peroxygen bleaching agent to bleach activator of from about 1:1 to 10:1.

6. A laundry detergent composition according to claim 1, wherein the bleach activator is selected from the group consisting of nonanyloxybenzene sulfonate; tetraacetyl ethylene diamine; (6-octanamidocaproyl) oxybenzenesulfonate (6-nonanamidocaproyl)oxybenzenesulfonate; (6-decanamidocaproyl )oxybenzenesulonate; benizoyl caprolactam; octanoyl caprolactam; 3,5,5-trimethylhexanoyl caprolactam; nonanoyl caprolactam; decanoyl caprolactam; undecenoyl caprolactam; benzoyl valerolactam; octanoyl valerolactam; nonanoyl valerolactam; decanoyl valerolactam; undecenovi valerolactam; 3,5,5-trimethylhexanoyl valerolactam; and mixtures thereof.

7. A laundry detergent composition according to claim 1, further comprising an ingredient selected from the group consisting of soil release agents, suds boosters, suds suppressors antitarnish agents, anticorrosion agents and mixtures thereof.

8. A granular laundry composition comprising:

a) from 5% to 50% by weight of a detersive surfactant;

b) from 1% to 50% by weight of an organic or inorganic detergency builder;

c) from 0.1% to 8% by weight of a polyamide-polyamine fabric treatment agent formed from repeating units of the structural formula:

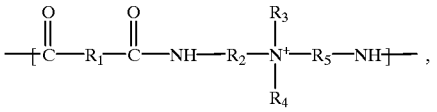

wherein $R_1$, $R_2$ and $R_5$ are each independently $C_{1-4}$ alkylene, $C_{1-4}$ alkarylene or arylene or wherein $R_1$ may not be present; $R_3$ is selected from the group consisting of hydrogen, epichlorohydrin, azetidinium group, epoxypropyl group and dimethylaminohydroxypropyl group: and $R_4$ is selected from the group consisting of hydrogen, $C_{1-4}$ alkyl, $C_{1-4}$ alkaryl and aryl groups, and $C_{1-4}$ alkyl, $C_{1-4}$ alkaryl and aryl groups condensed with $C_{1-4}$ alkylene oxide.

9. A granular laundry composition according to claim 8, comprising from 1.5% to 3.2%, by weight, of the polyamide-polyamine.

10. A granular laundry composition according to claim 9, wherein the builder comprises aluminosilicate.

11. A granular laundry composition according to claim 9, wherein the surfactant comprises an ingredient selected from the group consisting of linear alkylbenzene sulfonates, alkyl sulfates, alkyl ethoxylates and mixtures thereof.

12. A granular laundry composition according to claim 9, further comprising a peroxygen bleach.

13. A laundry detergent composition according to claim 17, further comprising a bleach activator in a weight ratio of peroxygen bleach to bleach activator of from about 1:1 to about 10:1.

* * * * *